United States Patent [19]

Morrison

[11] Patent Number: 4,571,066

[45] Date of Patent: Feb. 18, 1986

[54] ELECTROPHOTOGRAPHIC COPYING APPARATUS INCLUDING METHOD OF FORMATION OF TONER TRANSPORT GRID USED AS A PART OF DRUM CLEANING SYSTEM

[75] Inventor: Elden R. Morrison, Branchport, N.Y.

[73] Assignee: Ricoh Company, Ltd., Tokyo, Japan

[21] Appl. No.: 664,487

[22] Filed: Oct. 24, 1984

Related U.S. Application Data

[63] Continuation-in-part of Ser. No. 516,954, Jul. 25, 1983.

[51] Int. Cl.[4] ..... G03G 21/00

[52] U.S. Cl. ..... 355/15; 15/256.51; 118/652; 430/125

[58] Field of Search ..... 355/15, 3 R, 77; 15/256.51, 256.52; 118/652; 430/125

[56] References Cited

U.S. PATENT DOCUMENTS 3,700,328 10/1972 Davidge et al. ..... 355/3 DD
3,728,016 4/1973 Harbour et al. ..... 355/15
4,154,522 5/1979 Ikesue ..... 355/15

*Primary Examiner*—R. L. Moses

*Attorney, Agent, or Firm*—Flehr, Hohbach, Test, Albritton & Herbert

[57] ABSTRACT

A cleaning system for a photoconductive drum in an electrographic copying apparatus is provided by appropriate utilization of the surface charging and discharging components which are already provided adjacent the path of movement of the rotating surface of the drum. An electrostatic grid is formed on a non-image portion of the surface of the drum to carry the residual toner and carrier back to the developing station. As described in detail in the parent application, the residual toner is physically moved from the image bearing segment of the drum surface to the non-image bearing segment by means of a compliant roller member manipulated in a controlled fashion relative to the movement of the drum. Also, much of the residual toner which accumulates on the compliant member during this latter procedure is moved therefrom to the non-image bearing segment of the drum and held there by electrostatic attraction to the grid on the non-image bearing portion. The residual toner is removed from the non-image bearing drum segment by appropriate biasing of the development roller which is used initially to apply the toner to the surface of the drum.

5 Claims, 1 Drawing Figure

Figure 1:
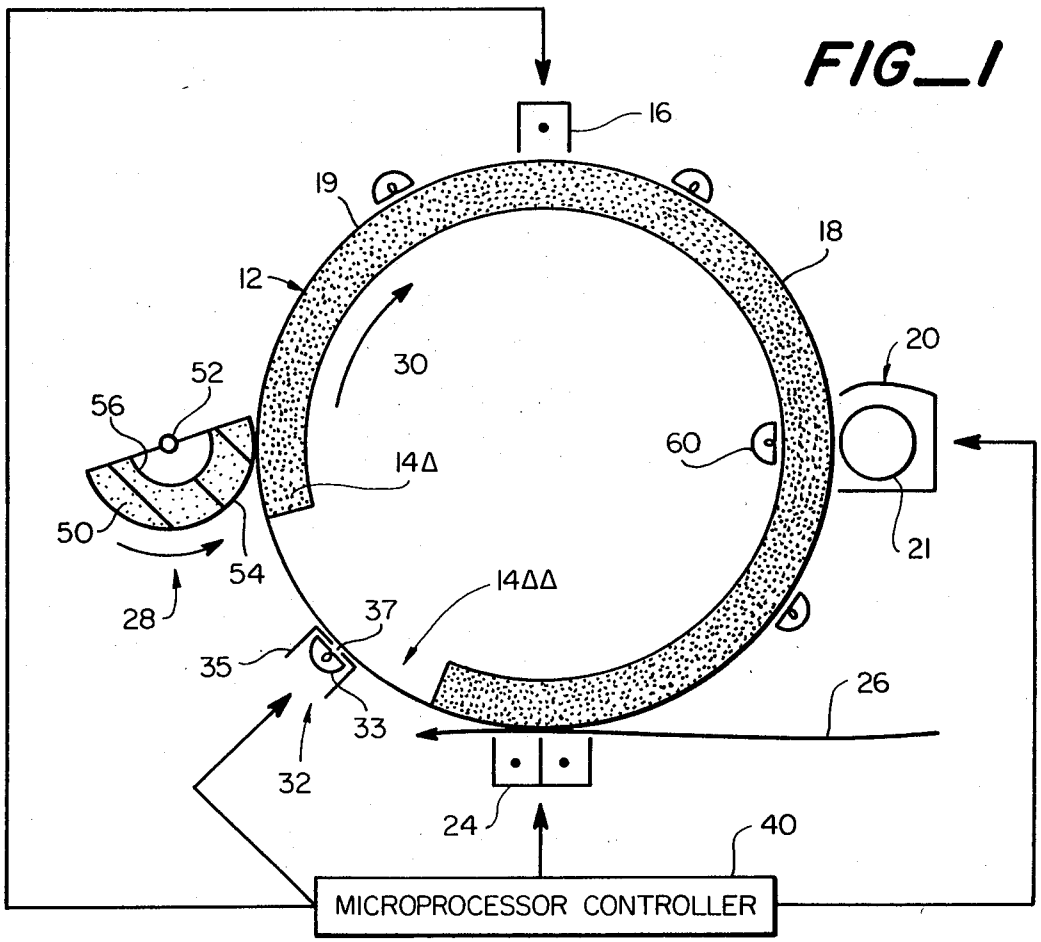

MICROPROCESSOR CONTROLLER
12
14Δ
14ΔΔ
16
18
19
20
21
24
26
28
30
32
33
35
37
40
50
52
54
56
60

ELECTROPHOTOGRAPHIC COPYING APPARATUS INCLUDING METHOD OF FORMATION OF TONER TRANSPORT GRID USED AS A PART OF DRUM CLEANING SYSTEM

This application is a continuation-in-part of U.S. application Ser. No. 06/516,954 filed July 25, 1983 and assigned to the assignee of the present application. This previous application is incorporated herein by reference.

The present invention relates generally to electrophotographic copying apparatus, and more particularly to a method of recycling toner without adding new components to the copying apparatus.

The present invention is especially suitable for use in an electrophotographic apparatus of the general type described in U.S. patent application Ser. No. 199,096 filed Oct. 20, 1980. The apparatus described therein (as shall be described in greater detail below to the extent necessary to understand the present invention) includes a rotatable drum having a photosensitive outer circumferential surface, and means for rotating the drum in a controlled fashion so that its outer circumferential surface defines a fixed annular path of movement. This apparatus produces copies of a given master by first forming an electrostatic latent image corresponding to the particular information to be copied on the photosensitive outer circumferential surface of the drum. Thereafter, the latent image formed is developed by means of toner which is supplied to the image bearing surface in a particular way. Finally, the applied toner is transferred from the drum to a blank sheet for transforming the latter to the desired copy. The apparatus necessary to carry out these various steps are specifically set forth in the pending application which is hereby incorporated by reference.

As is discussed at some length in the incorporated patent application, systems have been described in the prior art which move any residue toner i.e. toner which remains on the image segment of the drum's surface after image development, into a smaller, separate area of the drum's surface. Thereafter, this residual toner on this secondary toner attracting region is moved along with the drum about an annular path of movement to a particular location where means are provided for removing the accumulated toner, preferrably for reuse in the developing process.

However, the systems described in these prior art patents and the above incorporated application all incorporate a considerable amount of additional equipment to define the secondary toner carrying region. This is a considerable disadvantage in the price conscious market for electrophotographic copying systems.

It is an objective of the present invention to provide an improved method and apparatus for cleaning residual toner from the latent image on a drum.

It is a further objective of the present invention to provide an improved method for reusing residual toner without the need for separate recycling equipment.

Yet another objective of the present invention is to provide an uncomplicated and reliable method of improving the way in which residual toner is moved from the image bearing segment of the drum to an adjacent non-image bearing segment of the drum.

A related object of the invention is to provide an uncomplicated and reliable technique for holding residual toner on the secondary non-image bearing drum segment as the drum moves the toner from its pick up point to its point of removal.

Yet another objective of the present invention is to provide method and apparatus for moving residual toner from the latent image surface portion to the secondary residual toner carrying portion without the addition of new equipment to the copying apparatus.

It is another objective of the present invention to define a method and apparatus for removing the residual toner from this secondary non-image bearing segment of the drum's surface.

As described in detail in the incorporated application means are provided for forming an electrostatic grid on a non-image bearing portion of the surface area of the photoconductive drum to aid in electrostatically holding the residual toner on this non-image bearing surface portion. This grid is defined by a separate voltage supply which is connected through conductive elements to the non-image bearing surface portion of the drum; alternatively, a discharge grid placed adjacent the image bearing surface of the drum forms the grid on the drum's surface. It is an objective of the present invention to eliminate such additional components from the electrophotographic copying apparatus.

In accordance with the present invention, by appropriate utilization of the surface charging and discharging components which are already provided adjacent the path of movement of the rotating surface of the drum, the electrostatic grid is formed on a non-image portion of the surface of the drum. As described in detail in the parent application, the residual toner is then physically moved from the image bearing segment of the drum surface to the non-image bearing segment by means of a compliant roller member manipulated in a controlled fashion relative to the movement of the drum. Also, much of the residual toner which accumulates on the compliant member during this latter proceedure is moved therefrom to the non-image bearing segment of the drum and held thereby electrostatic attraction to the grid on the non-image bearing portion.

Finally, the residual toner is removed from the non-image bearing drum segment by appropriate biasing of the development roller which is used initially to apply the toner to the surface of the drum.

The various aspects of the present invention will be described in detail in conjunction with FIG. 1, the sole FIGURE in the application, which is a diagramatic illustration and plan view of an electrophotographic copying apparatus designed in accordance with the present invention.

The FIGURE specifically shows the essential elements which are used to charge the drum to varying potential level to accept and hold toner against a latent image, and which is accordance with the present invention may also be used to remove residual toner from the surface of the drum.

The copying apparatus in which this invention is used includes a rotatable photoconductive drum 12 having a photosensitive outer circumferential surface 14. Means (not shown) are provided for rotating the drum in a controlled manner to move the surface 14 along a fixed annular path through a charging station represented by the charging corotron 16, an exposure station 18 where the image area 19 is exposed to the image to be copied so that a latent image is formed on the photoconductive surface; and a developing station 20 including a developer roll which is appropriately biased to carry toner against the latent image to develop the image. The image then passes through a transfer or copy forming station including a transfer corotron 24 which charges a paper or other support document 26 with a uniform charge to support the transfer of the electrostatically charged toner from the image area on to the support surface. Finally, the image area rotates through a cleaning station generally indicated at 28 (and to be discussed in greater detail below) which cleans the residual toner from the image area so that the image area is prepared to accept the next latent image to be developed.

In the embodiment shown, a cylindrical drum is used; however, any suitable photoconductor could be used, such as an endless belt. Nevertheless, for purposes of convenience the term photoconductive drum will be used and being understood that the term refers to any photoconductor compatible with the present invention.

In actual operation, the drum 12 rotates in the direction of arrow 30 for bringing the first segment 14Δ of the photosensitive surface 14 (the segment darkened in the FIGURE) through the charging station 16 where a suitable decharging unit provides a high voltage to charge the surface. In this embodiment, most but not all of the circumference of the drum surface 14 is charged, leaving an uncharged segment 14ΔΔ (which is the non-darkened segment of FIG. 1). The charged circumferential segment 14Δ of the drum surface is moved through the exposure station 18 where an image of the original or master to be copied (not shown) is projected onto the moving drum to discharge portions of its discharged surface and thus form an electrostatic latent image conforming to the original. The electrostatic latent image thus formed is then moved through the developing station 20 which contains a supply of toner charged to a polarity opposite that of the latent image, and past means including charged roller 21 for applying the toner to the drum surface. Thus as the image bearing drum surface moves through the developing station 20 the charged toner is applied thereto, causing it to develop the latent image and form a visible powder image of the original.

Immediately after the latent image on drum surface 14 has been developed, it is moved through the transfer station which includes transfer corotron 24 and means for carrying a blank paper 26 through a fixed path in engagement with drum surface. When the paper 26 engages the drum surface 14, the developing toner is transferred from the drum surface to a section of the blank sheet, thereby forming a copy of the original. While not shown, means are also provided after the paper 26 departs the region of the drum for fusing the toner transferred to the sheet for making a permanant copy, and for cutting the permanent copy to the appropriate size corresponding to the original.

After the developed image has been transferred, the image bearing surface 14Δ moves past a pre-cleaning lamp 32 which is used to uniformly discharge the image area. It is apparent from the previous discussion that the image area 14Δ is first charged to a known protential and then is selectively discharged by the white or light areas of the latent image. Therefore, it is apparent that the image area 14Δ is uniformly discharged of the latent image by uniform application of light at the pre-cleaning lamp 32.

After the entire image bearing surface 14Δ has moved past the transfer corotron 24, this transfer corotron may be appropriately energized by the microprocessor controller 40 to uniformly charge the non-image bearing surface 14ΔΔ of the drum. This is accomplished because the microprocessor 40 can easily know where the trailing edge of the paper 26 or image area 14Δ is; when that point passes the transfer corotron 24, the corotron is again energized to a high level at least equal to (and of the same polarity as) that of the corotron 16 which was used to charge the image area of the drum. In this way the non-image 14ΔΔ is charged to a uniform high potential.

As explained in considerable detail in the parent application to this application incorporated herein by reference, the use of a grid comprising a sequence of positive and negative strips of electrostatic potential results in a greater toner holding capability then a single uniform field. The areas of electrostatic contrast generally establish electrostatic fields immediately over the surface segment 14ΔΔ which aid in attracting toner particles to the surface segment. These areas of contrast also aid in retaining toner particles of opposite polarities in the event wrong sign toner is accidentally provided. It is thus apparent that the clamp or grid which comprises closely spaced areas of differing potential or areas of electrostatic contrast could provide areas of positive versus negative potential; positive or negative versus ground; both positive but of differing magnitudes; or, both negative but of differing magnitudes. The important feature is that the grid comprise closely spaced areas of electrostatic contrast.

In order to simplify the control of the devices used in defining this electrostatic grid, it has been found that this can be most directly achieved by first providing a uniform charge over the region 14ΔΔ. Therafter, as this uniformly charged region 14ΔΔ moves under the pre-cleaning lamp 32, the regions of contrasting potential are provided.

This pre-cleaning lamp 32 typically comprises an LED array 33 enclosed in a shield 35 which has a narrow slit 37; it performs the function of uniformly discharging the image area in preparation of the cleaning function. When the suitably charged interdocument area 14ΔΔ arrives at this pre-cleaning lamp 32, the lamp 33 is pulsed or flashed under control of the controller 40 at a frequency designed to effect closely spaced sharply defined areas of differing potential on the surface of the photoconductive drum. That is, the lamp 33 selectively discharges narrow bands of the interdocument area that was previously charged by the transfer corotron 24. Thus an electrostatic grid region 14ΔΔ is defined which is subsequently used as the toner transport device as part of the unique cleaning system.

Thus a storage grid in a non-image area 14ΔΔ of the drum is defined for retaining the toner against the drum for efficient carriage of the toner back to the developer station 20 where it may be removed from the drum 10 and reused.

The image area 14Δ and nonimage (now grid) area 14ΔΔ next move through a mechanical cleaning station which typically includes a compliant (preferably foam) rubber roller 50 which is semi-cylindrical in configuration and is supported on a rotatable shaft 52. The shaft 52 is located sufficiently close to the drum surface 14 so that the surface 54 of the roller 50 engages the drum surface. The arrangement also includes means (not shown) for rotating the shaft 52 and therefore the roller segment in a controlled manner to be described below. In this regard, the important part of the function achieved is that the residual images are cleaned from the image area 14Δ by the segmented foam roller. An electrostatically active charging electrode 56 may be applied to the back surface of the roller to pick up toner during the cleaning phase.

That is, the cleaning roller 50 is rotated opposite to the direction of rotation of the photoconductive drum in this pickup or cleaning stage, sweeping the residual toner before it, and picking up some of the toner on the surface of the roller 50. As the roller 50 reaches the non-image area 14ΔΔ which now contains the toner grid, the roller 50 is released from the driving means 52 to be friction driven by the photoconductive drum 18 so that little or no relative motion exists between the contacting surface roller 50 and contact surface 14ΔΔ. The polarity on the electrode 56 is also reversed. Therefore, during this deposition phase, the foam roller 50 rolls against the nonimage bearing surface 14ΔΔ, and the toner is pressed against and attracted to the electrostatic grid surface 14ΔΔ so that the foam roll 50 is cleaned of toner material by the electrostatic attraction of the grid. As noted above, the bias on the electrode 56 is reversed so that the electrode 56 interior to the foam roller 50 supports the deposition process.

At this point, the residual toner is electrostatically attracted to the photoconductive drum and can be transported to the developing station 20. At the developing station, the electrical bias on the development electrode 21 is manipulated in a manner to maximize the ability of the developer to clean the residual toner from the interdocument area. The residual toner is thus reintroduced into the developer station 20, completing the operation. The image area 14Δ has already been effectively cleaned of all residual toner. Therefore, even if the cleaning of the non-image area is not fully effective on each pass, since it is the non-image area 14ΔΔ which contains all the residual toner, no harm results to the accuracy of reproduction of latent images.

In a further refinement of the present invention, a translucent material may be used for the photoconductive drum. In this instance a discharge lamp 60 may be located in the interior of the drum approximately facing the developing station and appropriately biased to discharge the electrostatic grid and thereby assist in the cleaning of this interdocument grid area by photodischarge of the grid pattern when the pattern is adjacent the developing region.

It can be seen that by following the process described above, only those elements of a electrophotographic developing system which must already have been provided in order to provide proper charging and discharging of a photoconductive drum to achieve accurate copies can also be used in conjunction with the foam drum sweeping roller 50 to more effectively clean a photoconductive drum, and move the residual toner back to the developing station for effective reuse. The programming of the microprocessor controller 40 to achieve this sequence is straight forward, and therefore not disclosed in detail; the necessary control sequence is apparent from the above.

Other modifications of this method may become apparent to a person of skill in the art who studies the subject invention disclosure. Therefore, the scope of the present invention is to be limited only by the following claims.

What is claimed:

1. A method of electrophotographically copying information from a given master, comprising the steps of:

(a) providing a rotatable drum having a photosensitive outer circumferential surface and means for rotating the drum about its longitudinal axis and along a fixed annular path in a controlled fashion;

(b) forming a given electrostatic latent image corresponding to said information on a first circumferential image segment of said drum surface;

(c) applying toner from a given toner storage area onto the image bearing first segment of said drum surface in a way which develops said image;

(d) providing a transfer corotron actuatable to electrostatically charge a support surface to attract the toner comprising said developed image;

(e) transferring said applied toner from said segment of said drum to said support surface to form a copy of said image;

(f) after the application of toner onto said first segment of said drum surface bearing said given image and the subsequent transfer of said applied toner onto said support surface to produce at least one copy, actuating said transfer corotron to charge a second, non-image segment of said drum surface with a toner attracting charge level and polarity grid at a first point on said annular path;

(g) providing a pre-clean lamp for uniformly discharging the image bearing first segment of the drum surface, and repetitively actuating said preclean lamp to selectively discharge band portions of said charged second non-image segment to define a charged toner transport grid in said second segment;

(h) moving any of said applied but untransferred toner from said first segment to said second segment;

(i) rotating said drum in a way which moves said second segment from said first point to a second point on said annular path; and (j) removing the toner from said second segment of said drum surface at said second point.

2. A method of electrophotographically coping information from a given master, comprising the steps of:

(a) providing a rotatable drum having a photosensitive outer circumferential surface and means for rotating the drum about its longitudinal axis and along a fixed annular path in a controlled fashion;

(b) forming a given electrostatic latent image corresponding to said information on a first circumferential image segment of said drum surface;

(c) applying toner from a given toner storage area onto the image bearing first segment of said drum surface in a way which develops said image;

(d) providing a transfer corotron actuatable to electrostatically charge a support surface to attract the toner comprising said developed image;

(e) transferring said applied toner from said segment of said drum to said support surface to form a copy of said image;

(f) after the application of toner onto said first segment of said drum surface bearing said given image and the subsequent transfer of said applied toner onto said support surface to produce at least one copy, actuating said transfer corotron to charge a second, non-image segment of said drum surface with a toner attracting charge level and polarity grid at a first point on said annular path;

(g) moving any of said applied but untransferred toner from said first segment to said second segment;

(h) providing a semicircular roller segment of compliant material adjacent said drum;

(i) placing said roller segment into engagement with said first segment of said drum surface and maintaining said roller segment in a stationary position while rotating the latter after said applied toner is transferred from said first segment to form said copy in order to cause the applied but untransferred toner to accumulate on said second segment of said drum surface and/or on the roller segment itself;

(j) thereafter placing said roller segment in engagement with said second surface segment and rotating the drum segment about an axis parallel to the axis of said drum at the same rate of rotation as that of the drum but in the opposite direction while rotating the drum and after said electrostatic grid has been provided on said second segment whereby to transfer any of said toner accumulated on said roller segment to said second surface segment;

(k) rotating said drum in a way which moves said second segment from said first point to a second point on said annular path; and (l) removing the toner from said second segment of said drum surface at said second point.

3. A method of electrophotographically coping information from a given master, comprising the steps of:

(a) providing a translucent rotatable drum having a photosensitive outer circumferential surface and means for rotating the drum about its longitudinal axis and along a fixed annular path in a controlled fashion;

(b) forming a given electrostatic latent image corresponding to said information on a first circumferential image segment of said drum surface;

(c) applying toner from a given toner storage area onto the image bearing first segment of said drum surface in a way which develops said image;

(d) providing a transfer corotron actuatable to electrostatically charge a support surface to attract the toner comprising said developed image;

(e) transferring said applied toner from said segment of said drum to said support surface to form a copy of said image;

(f) after the application of toner onto said first segment of said drum surface bearing said given image and the subsequent transfer of said applied toner onto said support surface to produce at least one copy, actuating said transfer corotron to charge a second, non-image segment of said drum surface with a toner attracting charge level and polarity grid at a first point on said annular path;

(g) moving any of said applied but untransferred toner from said first segment to said second segment;

(h) rotating said drum in a way which moves said second segment from said first point to a second point on said annular path;

(i) removing the toner from said second segment of said drum surface at said second point, including the steps of positioning a discharge lamp in the interior of said drum adjacent and facing said developer station, and illuminating said lamp during passage of said second segment between said lamp and said developing station to discharge said toner attracting grid and release said toner from the second segment to fall into the developing station.

4. A method as claimed in claim 3 further comprising providing a developing station for carrying out said step (c) in developing said image, said developing station including a developer roll biased to apply toner to the latent image area, clearing of said drum segment comprising the steps of changing the bias on said roller to attract residual toner from said rotatable drum.

5. A method as claimed in claim 3 wherein said bias is modified only while said developer roll is passing over said second segment of said drum surface.

* * * * *

UNITED STATES PATENT AND TRADEMARK OFFICE

CERTIFICATE OF CORRECTION

PATENT NO. : 4,571,066

DATED : February 18, 1986

INVENTOR(S) : Elden R. Morrison

It is certified that error appears in the above—identified patent and that said Letters Patent is hereby corrected as shown below: Title page:

The Assignee should read as follows:

[73] Assignee: Ricoh Company, Ltd., Tokyo, Japan, and Ricoh Systems, Inc., San Jose, California Signed and Sealed this

*Fifteenth* Day of *July 1986*

[SEAL]

*Attest:*

*Attesting Officer*

DONALD J. QUIGG

*Commissioner of Patents and Trademarks*